US011377343B2

(12) United States Patent
Schleese

(10) Patent No.: US 11,377,343 B2
(45) Date of Patent: Jul. 5, 2022

(54) ADJUSTABLE GULLET PLATE WITH INTERCHANGEABLE PORTIONS

(71) Applicant: SCHLEESE SADDLERY SERVICE LTD., Holland Landing (CA)

(72) Inventor: Joachim Schleese, Newmarket (CA)

( * ) Notice: Subject to any disclaimer, the term of this patent is extended or adjusted under 35 U.S.C. 154(b) by 0 days.

(21) Appl. No.: 16/932,749

(22) Filed: Jul. 18, 2020

(65) Prior Publication Data

US 2022/0017360 A1 Jan. 20, 2022

(51) Int. Cl.
*B68C 1/04* (2006.01)

(52) U.S. Cl.
CPC ..... *B68C 1/04* (2013.01)

(58) Field of Classification Search
CPC ..... B68C 1/04; B68C 2001/042–048; B68C 1/02
See application file for complete search history.

(56) References Cited

U.S. PATENT DOCUMENTS

| | | | | |
|---|---|---|---|---|
| 2013/0192177 | A1* | 8/2013 | Strauss | B68C 1/025 54/44.3 |
| 2013/0269300 | A1* | 10/2013 | Konzet | B68C 1/025 54/44.1 |
| 2016/0101973 | A1* | 4/2016 | Hennig | B68C 1/025 54/44.3 |
| 2017/0313572 | A1* | 11/2017 | Aksoyek | B68C 1/12 |
| 2020/0317503 | A1* | 10/2020 | Benetti | B68C 1/025 |

FOREIGN PATENT DOCUMENTS

| | | | | |
|---|---|---|---|---|
| AU | 2004202099 | A1 | 12/2004 | |
| AU | 2017101234 | A4 | 10/2017 | |
| DE | 202014105189 | U1 * | 8/2015 | B68C 1/04 |
| EP | 0328376 | B1 | 10/1991 | |
| GB | 191418567 | A * | 8/1915 | B68C 1/04 |
| GB | 2239158 | A | 6/1991 | |
| GB | 2423230 | A | 8/2006 | |
| IN | 201711031920 | A * | 10/2017 | B68C 1/02 |

* cited by examiner

*Primary Examiner* — Timothy D Collins
*Assistant Examiner* — Madeline L Douglas
(74) *Attorney, Agent, or Firm* — Heer Law; Christopher Heer; Ian Goodman

(57) ABSTRACT

An adjustable gullet plate with interchangeable, adjustable portions and joints which are connected and secured to one another using interlocking elements and fasteners. The adjustable gullet plate may include interlocking elements equally spaced at or at about known increments and terminal portions connected successively to create points of adjustment. The gullet plate may be adjusted into an asymmetric configuration to fit a horse with an asymmetric body shape. The adjustable gullet plate can be installed in a saddle and then be adjusted to fit a horse's body shape by accessing at least one fastener securing an adjustable joint, loosening the fastener to disengage interlocking elements to permit radial movement, adjusting the radial displacement and interior angle of at least one adjustable portion to fit a horse's body shape, and tightening the fastener to reengage the interlocking elements and prevent further radial movement.

20 Claims, 11 Drawing Sheets

ADJUSTABLE GULLET PLATE WITH INTERCHANGEABLE PORTIONS

FIELD OF THE INVENTION

The present specification relates generally to gullet plates and more specifically to a gullet plate with radially adjustable joints and interchangeable parts that may be installed in a saddle tree system and adjusted incrementally to accommodate different horse body shapes or changes therein.

BACKGROUND OF THE INVENTION

A proper fit between a saddle and a horse's body shape is paramount to not only maximizing comfort and freedom of movement while riding, but also minimizing risk to a horse's health and well-being. Horses have historically been an asset both in work and sport and, as competitive riding became increasingly popular, the saddle industry evolved to meet the various demands of those seeking the best riding equipment. Different saddle types, like English, Western, and military saddles, were devised with the diverse needs of contemporary riders in mind and with each unique saddle reflecting the different demands a horse and rider may encounter.

Nonetheless, there are several common goals in designing the saddle trees that provide saddles with their shape and fit. All saddle trees must bridge the withers, appropriately distribute weight, and balance the rider. Furthermore, saddle fitting must focus on numerous factors to ensure that performance, comfort, and the health of the horse are not impeded by a poor fit. In particular, a proper fit must account for saddle balance, wither clearance, gullet channel for spinal clearance, gullet width, panel contact, billet alignment, saddle straightness, saddle length, tree angle, and tree width. Absent a calculated match between any of these factors to a horse's body shape, a horse may experience significant health problems and a restricted range of movement.

Even after accounting for these various factors, a horse's body shape may change. Muscular atrophy is common among horses who do not receive consistent training and may even occur in response to an ill-fitting saddle during active training. Changes in muscle mass and posture can also occur rather quickly, with mere weeks of training, or a lack thereof, causing a horse to gain or lose muscle mass.

These common and often recurring changes in horse body shape can cause several health problems if unaddressed with a refitted saddle. For example, a horse may experience muscle tightness at the front edge of its shoulder blades if the gullet plate pinches at the withers on the trapezius muscle, causing the horse to contract the muscle to avoid pain. A horse may also experience lameness if the insertion of the trapezius is pinched at the withers, once more, because of a saddle gullet plate that is too narrow in tree width and tree angle. Horses may also twitch, lose hair, blister, buck, or exhibit shortened strides or other movement limitations if subjected to an ill-fitting saddle.

Accordingly, there is a need for improvements in the art.

SUMMARY OF THE INVENTION

In an embodiment of the present invention, there is provided an adjustable gullet plate comprised of two apex portions, an adjustable apex joint, at least one terminal portion, at least one adjustable terminal joint, wherein the two apex portions are connected to the adjustable apex joint in the center, and wherein at least one of the apex portions is connected to the at least one terminal portion at the at least one adjustable terminal joint, and wherein the apex portions and the at least one terminal portion contain interlocking elements, and wherein the adjustable apex joint and the at least one adjustable terminal joint are secured using at least one fastener.

According to an embodiment, the adjustable gullet plate may be further comprised of at least two terminal portions connected to each other at an at least second adjustable terminal joint.

According to an embodiment, the two apex portions and the at least one terminal portion are interchangeable with different apex portions or terminal portions to optimize saddle fit.

According to an embodiment, the interlocking elements are spaced at equal radial increments of known radial displacement.

According to an embodiment, the dimensions and designs of the two apex portions and the at least one terminal portion of the adjustable gullet plate are configured for use in an English saddle.

According to an embodiment, an interior width or an interior angle between any combination of the apex portions or the at least one terminal portion can be increased or decreased using the adjustable apex joint or the at least one adjustable terminal joint to optimize saddle fit, even asymmetrically.

In an embodiment of the present invention, there is provided a saddle system comprised of a saddle tree, a gullet, at least one saddle tree covering, and an adjustable gullet plate further comprised of two apex portions, an adjustable apex joint, at least one terminal portion, at least one adjustable terminal joint, wherein the two apex portions are connected to the adjustable apex joint, and wherein at least one of the apex portions is connected to the at least one terminal portion at the at least one adjustable terminal joint, and wherein the apex portions and the at least one terminal portion contain interlocking elements, and wherein the adjustable apex joint and the at least one adjustable terminal joint are secured using at least one fastener. According to a preferred embodiment, there is one adjustable apex joint and two adjustable terminal joints, each of which is secured by a single fastener.

According to an embodiment, the adjustable gullet plate is secured to the saddle tree using at least one installation fastener. According to a preferred embodiment, the adjustable gullet plate is secured to the saddle tree using at least four installation fasteners on each side—two on each apex portion, and two on each terminal portion.

According to an embodiment, the dimensions and designs of the two apex portions, the at least one terminal portion, the saddle tree, and the saddle tree covering, are configured for use in an English saddle.

In an embodiment of the present invention, there is provided a method of adjusting an adjustable gullet plate while the adjustable gullet plate is installed in a saddle system, comprised of accessing at least one fastener securing at least one adjustable apex joint or at least one adjustable terminal joint of the adjustable gullet plate, loosening the at least one fastener to disengage interlocking elements on any combination of at least one apex portion or at least one terminal portion to permit radial movement of the at least one apex portion or the at least one terminal portion, adjusting the radial displacement of any combination of the at least one apex portion or the at least one terminal portion to adjust at least one interior tree angle or at least one interior tree width to fit a horse's body shape, and tightening the fastener to engage interlocking elements on any combination of the at least one apex portion or the at least one terminal portion to prevent radial movement of the at least one apex portion or the at least one terminal portion.

According to an embodiment, the method of adjusting an adjustable gullet plate is based on at least one equally spaced radial increment of the interlocking elements.

According to an embodiment, the method of adjusting an adjustable gullet plate could create an asymmetric or symmetric configuration to fit a horse's body shape. This is determined by adjusting at least one of the terminal portions, not the apex portion. According to an embodiment, the apex portions can be adjusted for tree width and tree angle symmetrically only, whereas the terminal portions can be adjusted asymmetrically for tree angle.

Other aspects and features according to the present application will become apparent to those ordinarily skilled in the art upon review of the following description of embodiments of the invention in conjunction with the accompanying figures.

BRIEF DESCRIPTION OF THE FIGURES

The principles of the invention may better be understood with reference to the accompanying figures provided by way of illustration of an exemplary embodiment, or embodiments, incorporating principles and aspects of the present invention, and in which.

DETAILED DESCRIPTION OF EMBODIMENTS OF THE INVENTION

Figure 1:
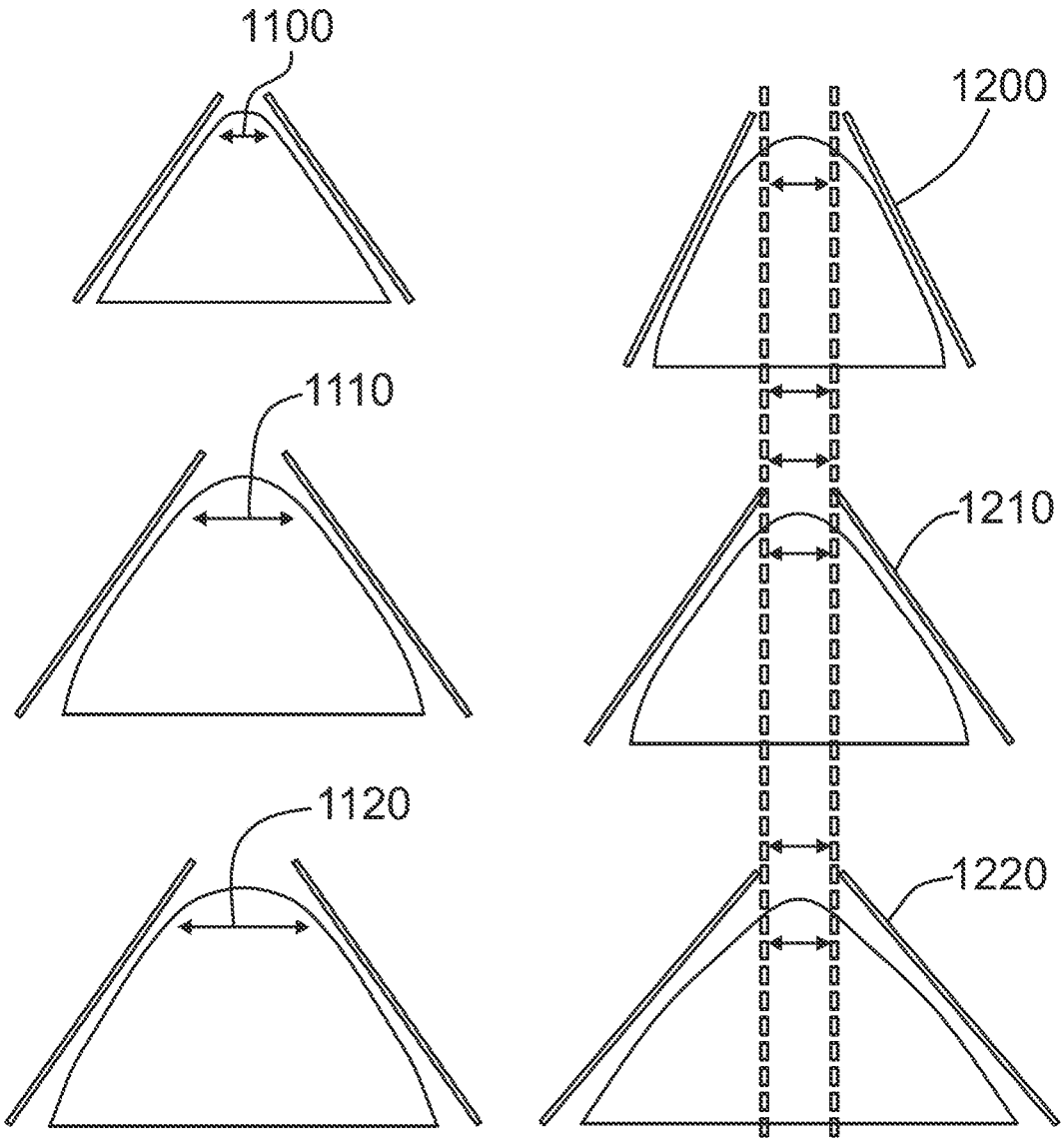
FIG. 1 illustrates how tree width and tree angle affect saddle fit.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order to more clearly to depict certain features of the invention.

According to an embodiment, this description relates to adjustable gullet plates with radially adjustable joints and interchangeable parts that may be installed in a saddle tree system and a method of adjustment to accommodate different horse body shapes or changes therein.

According to an embodiment, the present description relates to an adjustable gullet plate comprising two apex portions, an adjustable apex joint, at least one terminal portion, at least one adjustable terminal joint, wherein the two apex portions are connected to the adjustable apex joint, and wherein at least one of the apex portions is connected to the at least one terminal portion at the at least one adjustable terminal joint, and wherein the adjustable apex joint and the at least one adjustable terminal joint are secured using at least one fastener.

According to an embodiment, the present description relates to interlocking elements housed within either end of apex portions and within at least one end of at least one terminal portion and which may be equally spaced at about 5° radial increments.

According to an embodiment, the present description relates to an adjustable gullet plate with dimensions and designs of two apex portions and at least one terminal portion configured for use in an English saddle.

According to an embodiment, the present description relates to adjusting the interior tree width or interior tree angle between any combination of the apex portions or the at least one terminal portion using an adjustable apex joint or at least one adjustable terminal joint. According to an embodiment, the apex portions can be adjusted for tree width and tree angle symmetrically only, whereas the terminal portions can be adjusted asymmetrically for tree angle.

According to an embodiment, the present description relates to securing an adjustable gullet plate to the saddle tree using at least one installation fastener. According to an embodiment with two apex portions and two terminal portions on each side of the adjustable gullet plate, the adjustable gullet plate is fastened to the saddle tree with a total of 9 fasteners—one at the top, and two for each portion on each side.

Adjusting Tree Angle and Tree Width to Ensure Asymmetric or Symmetric Saddle Fit Matching tree angle and tree width to a horse's naturally uneven conformation and body shape is instrumental in ensuring a proper saddle fit and minimizing the risk of injury to both horse and rider. A mismatched tree angle or tree width (on either side of the horse) can also affect saddle balance, wither clearance, panel contact, saddle straightness, spinal clearance, saddle length, balance alignment point and billet alignment, which can further impede a rider's ability to compete to the best of their ability.

Both tree angle and tree width are largely determined by the structure and dimensions of the gullet plate installed in a saddle tree. The angle of the tree must be adjusted to match the angle of a horse's shoulders. As a horse moves, the shoulders will rotate upwards and backwards, and an appropriate tree angle must match the angle of the horse's shoulders as it moves.

Similarly, the tree width at the gullet plate of a saddle must be wide enough for a horse's shoulders to rotate freely under the tree. However, if the tree width is too wide, the entire saddle may rock or slip during riding or the back half of the saddle may twist to one side or the other. If the tree width is too narrow, the horse will experience scapular damage and possible muscle atrophy with increased risk of injury to the horse and rider, as the horse's ability to move freely is grossly impeded.

FIG. 1 illustrates how saddle fit is generally determined by adjusting tree angle and tree width. Three different saddle tree widths matched to the widths of a horse's withers 1100, 1110, and 1120 and three different saddle tree angles 1200, 1210, and 1220 are shown to illustrate the impact of increasing or decreasing such tree widths or tree angles in fitting a saddle to a horse's body shape. Wider withers ought to be fitted with a wider tree width, whereas the broader a horse's shoulders relative to its withers, the more likely a broader tree angle would be suitable.

In reducing the risk of injury, it is important to match the dimensions of the saddle to the unique contours of a horse's body. Consequently, saddles are best fitted where both tree angle and tree width are adjusted together. Merely adding flocking to or removing flocking from the vertical panels of a saddle will not adequately solve problems arising from a mismatched tree angle or tree width. Instead, the gullet plate must be either replaced or adjusted.

However, matching a gullet plate to the unique musculature and posture of a horse can be a nuanced and difficult exercise. This exercise is further complicated by the natural cycles of muscle growth and posture change that accompany regular training and riding or muscle atrophy that may occur when a horse is not receiving regular exercise.

Thus, gullet plates must be reassessed regularly to determine whether refitting is necessary. If a gullet plate needs to be replaced, various saddle components often need to be disassembled to access and remove the old gullet plate and install a new plate that matches the new dimensions of the horse. Furthermore, a rider may need to own a multitude of gullet plates of different dimensions to ensure appropriate saddle fit throughout a riding season. Professionals refitting a saddle may also need to conduct some trial and error in evaluating an appropriate fit because the dimensions of a saddle may not be adjusted via gullet plate replacement while the saddle is on a horse. This further adds to the overall duration and complexity of a saddle refitting. There is also some risk of damage to the saddle if removal and installation are not conducted carefully by a trained expert. For example, some of the more delicate leather or synthetic materials may tear if gullet plate swapping is conducted too hastily or haphazardly.

Every horse's musculature and posture are unique and there are often subtle differences in angle and width at multiple points across its back. Inaccurate fits result from the use of saddle trees configured in such a way that does not reflect the natural shape of a horse's body and the resulting ill-fitting saddles may harm a horse and impede rider performance or comfort.

Consequently, increasing the number of possible saddle configurations by introducing additional points of adjustment on a gullet plate that reflect the natural, generally uneven shape of a horse can help ensure saddles fit comfortably without the need for replacing one ill-fitting gullet plate with an entirely different gullet plate. Using radially adjustable joints and interchangeable gullet plate parts improves the speed and accuracy of a saddle fitting and methods that permit gullet plate adjustment while installed in a saddle reduce the burden on and requisite expertise of the party performing the adjustment. A method of adjustment may be intuitive and easy to conduct such that riders can self-adjust the gullet plate to match the configuration of a saddle to their horse's body shape and would only have to use common household tools, if any. This is increasingly important when considering that horses go through regular cycles of muscle gain and loss and that nearly all horses have some degree of natural asymmetry to their body shape. Furthermore, such asymmetry cannot be adequately accommodated in saddle fitting by making a symmetric change to the saddle's structure. Put another way, such symmetric changes may increase the suitability of the saddle's fit on one side of the horse to the detriment of the other side.

Figure 2A:
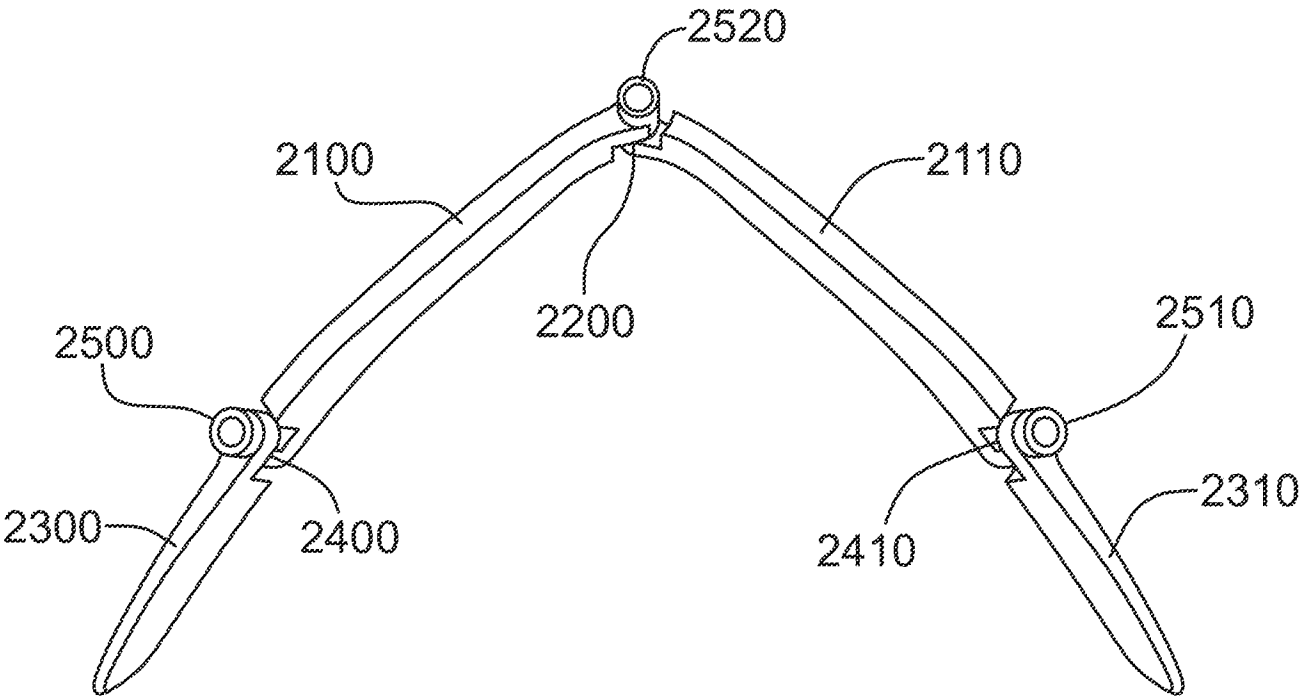
FIGS. 2(*a*) to 2(*b*) show a front and top view of an adjustable gullet plate, according to an embodiment.
Figure 2B:
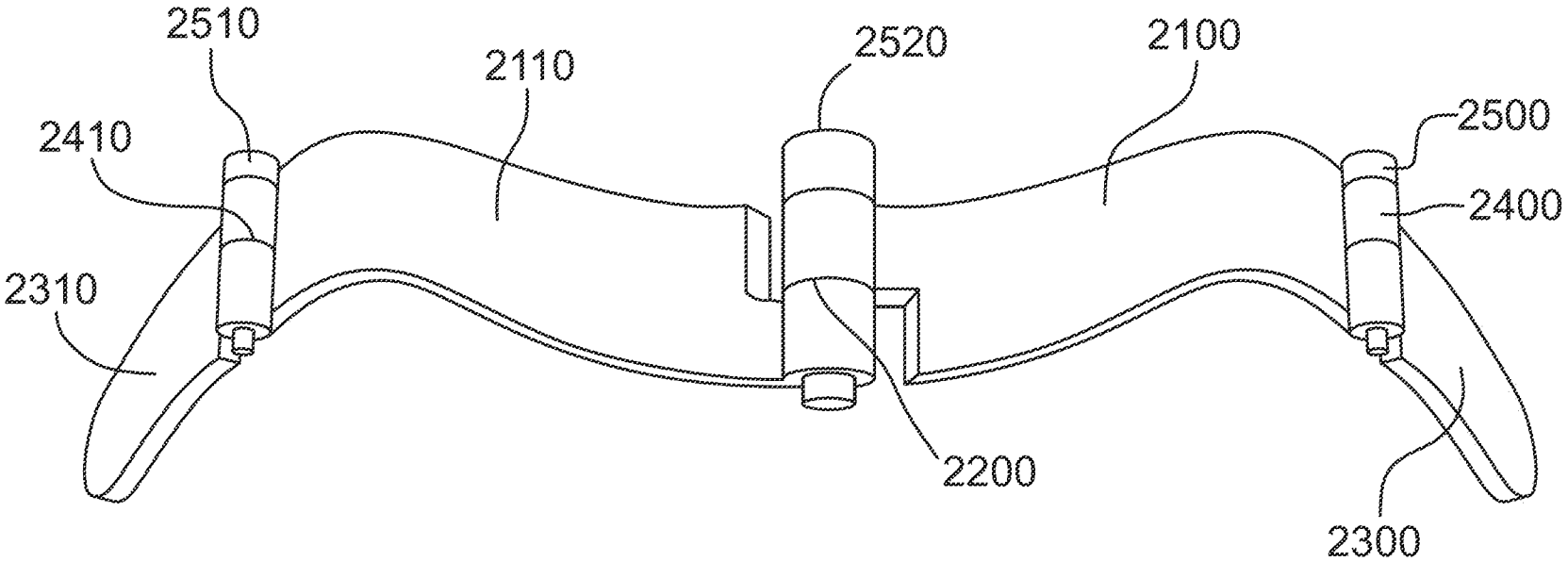

An Adjustable Gullet Plate that Accurately Matches Horse Body Shape on Both Left and Right Sides According to an embodiment as shown in FIG. 2(*a*), there is an adjustable gullet plate with interchangeable parts designed as two apex portions 2100 and 2110 connected to an adjustable apex joint 2200 at one end and each connected to one of two terminal portions 2300 and 2310 at one of two terminal joints 2400 and 2410 at the other end of the apex portions. According to the embodiment shown in FIG. 2(*a*), three screw-based fasteners 2500, 2510, and 2520 are used to secure interlocking elements housed within either end of the two apex portions and within one end of each of the two terminal portions. FIG. 2(*b*) shows a top side view of the same embodiment.

Figure 3:
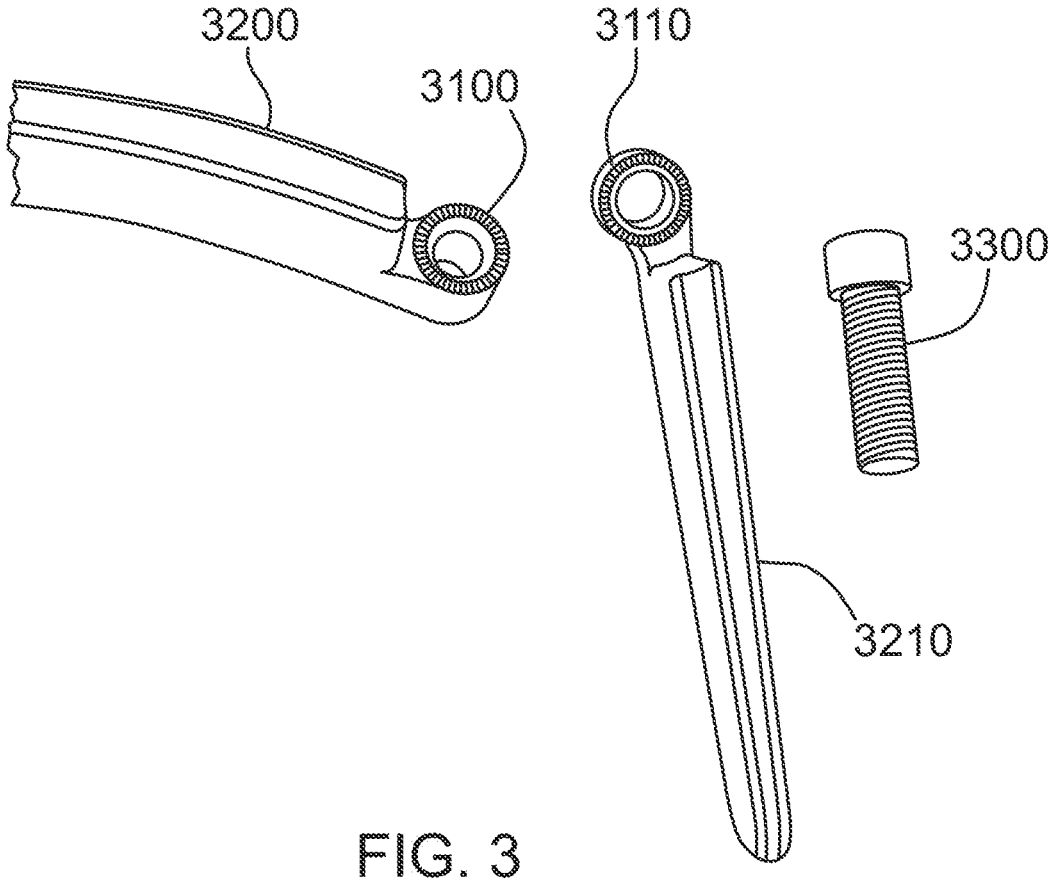
FIG. 3 shows an embodiment with interlocking elements and a screw-based fastener.
Figure 4A:
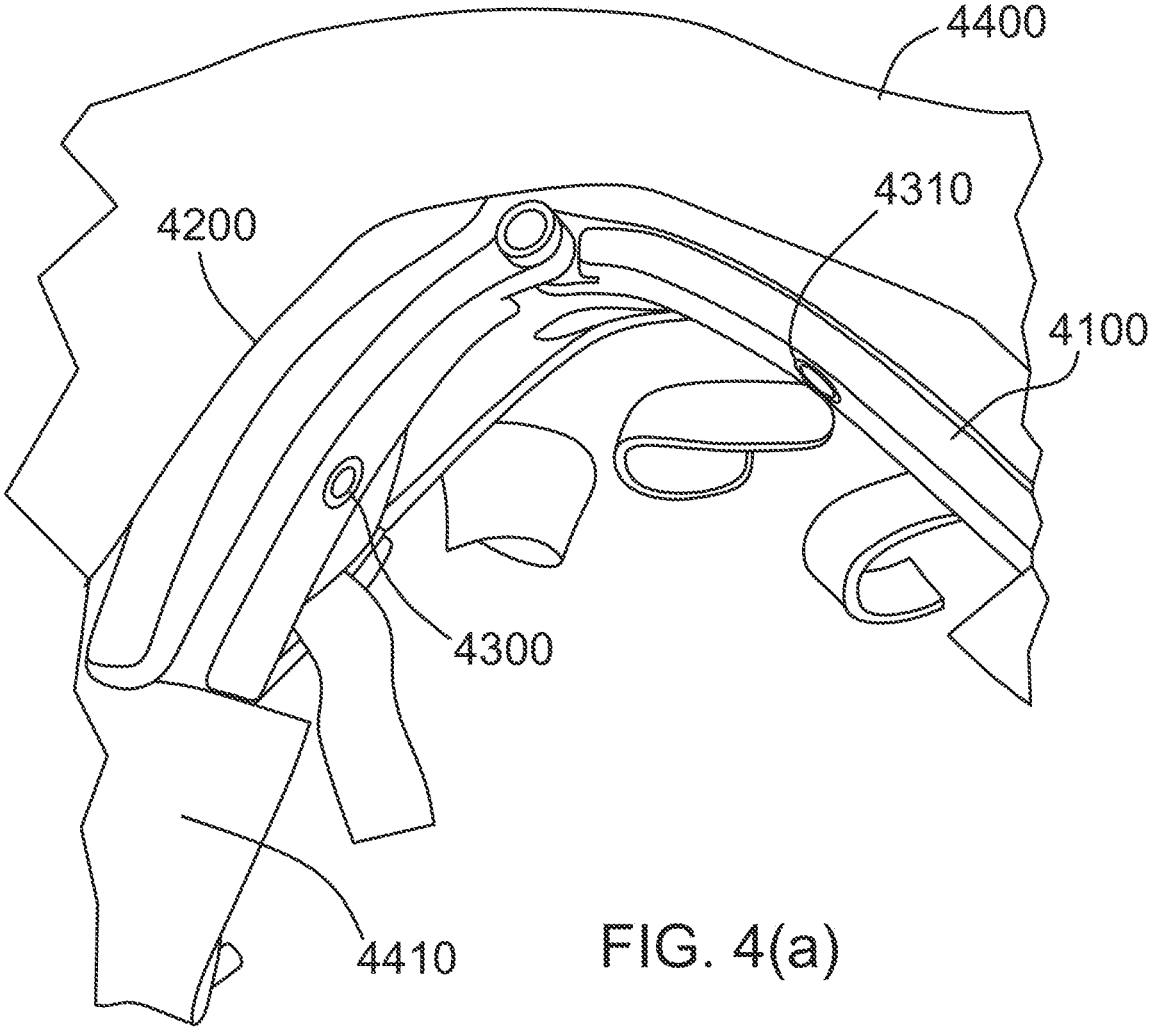
FIGS. 4(*a*) to 4(*d*) show an adjustable gullet plate installed in a saddle, according to an embodiment.
Figure 4B:
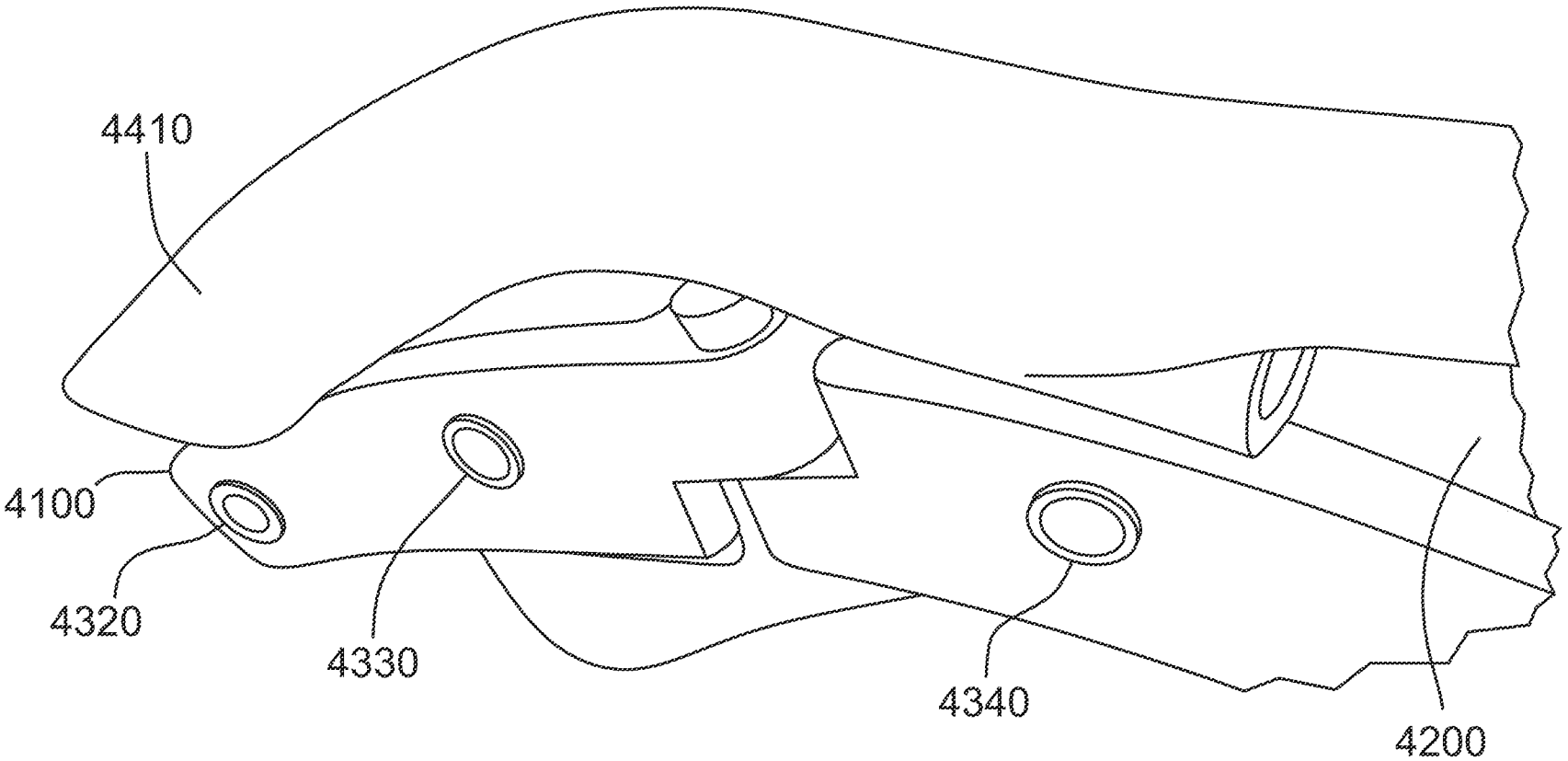
Figure 4C:
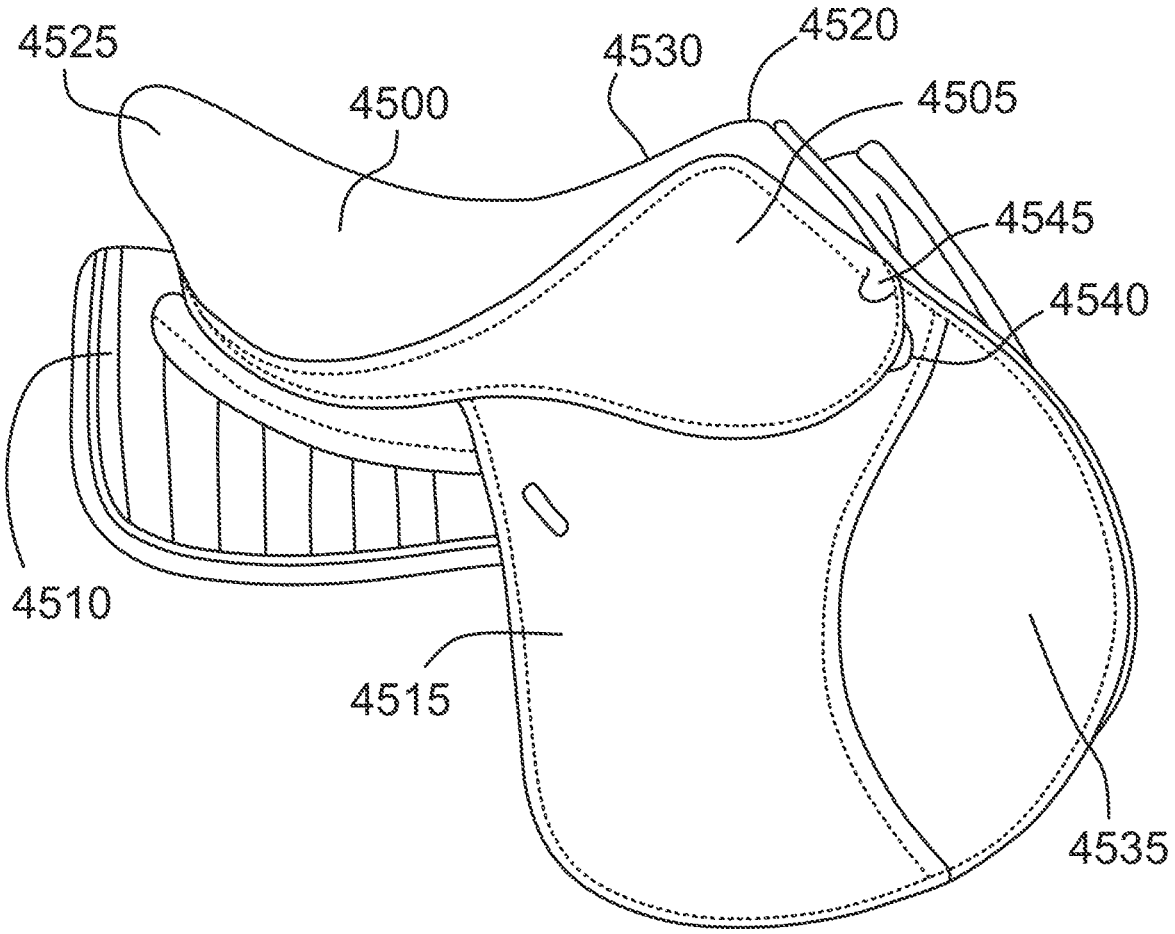
Figure 4D:
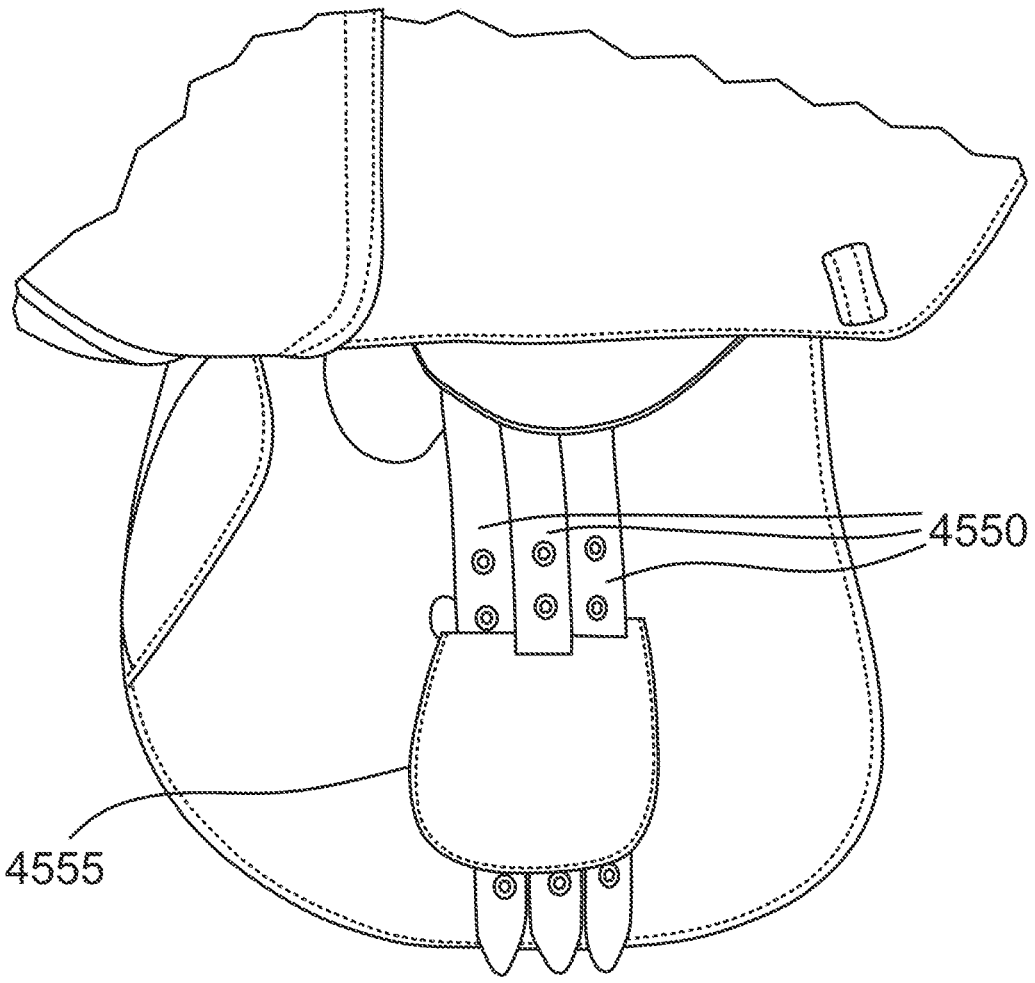

According to an embodiment as shown in FIG. 3, there are interlocking elements 3100 and 3110 housed within the ends of any combination of apex or terminal portions 3200 and 3210 and which may be used to secure the adjustable gullet plate in a desired configuration with the use of a screw-based fastener 3300. According to a further embodiment, the interlocking elements may be of different depths to more securely lock any combination of apex or terminal portions into an adjusted configuration. According to an embodiment, the interlocking elements are spaced at equal radial increments. According to a further embodiment, the interlocking elements are spaced at known radial increments of about 5°.

According to an embodiment, an adjustable gullet plate may be installed in a saddle. According to a further embodiment, the saddle includes a saddle tree, gullet plate, and at least one saddle tree covering. According to a further embodiment, the adjustable gullet plate is secured to the saddle tree using at least one installation fastener. According to an embodiment comprised of two apex portions and one terminal portion, at least five installation fasteners are used to secure the gullet plate to the saddle tree on the side with the terminal portion, with one at the top of the apex portion and two for each portion of the apex and terminal portions, and at least one or two more installation fasteners on the side with only the apex portion. According to embodiments shown in FIGS. 4(*a*) to 4(*b*), an adjustable gullet plate 4100 is installed in a saddle tree 4200 of a saddle using installation fasteners 4300, 4310, 4320, 4330, and 4340 and is covered by leather saddle seat on top (4400 and 4410) and by gullet leather on the bottom. According to an embodiment shown in FIG. 4(*c*) and FIG. 4(*d*) where the adjustable gullet plate is configured for use in an English saddle, the saddle tree coverings of the saddle may be comprised of leather or synthetic material, or any combination thereof and may include a seat 4500, skirt 4505, panel 4510, flap 4515, pommel 4520, cantle 4525, and waist 4530 or at least one knee roll 4535, stirrup leather, stirrup leather keeper, stirrup pad, stirrup iron, stirrup bar, D-ring 4540, seat nail 4545, billet 4550, or buckle guard 4555.

According to an embodiment, the apex and terminal portions of an adjustable gullet plate can be removed and replaced in a piece-wise manner. According to a further embodiment, an apex or terminal portion may be removed and replaced with an apex or terminal portion of different dimensions and design. Such a replacement can be done to match the dimensions and design of an apex or terminal portion to the natural contours of a horse's body.

Figure 5:
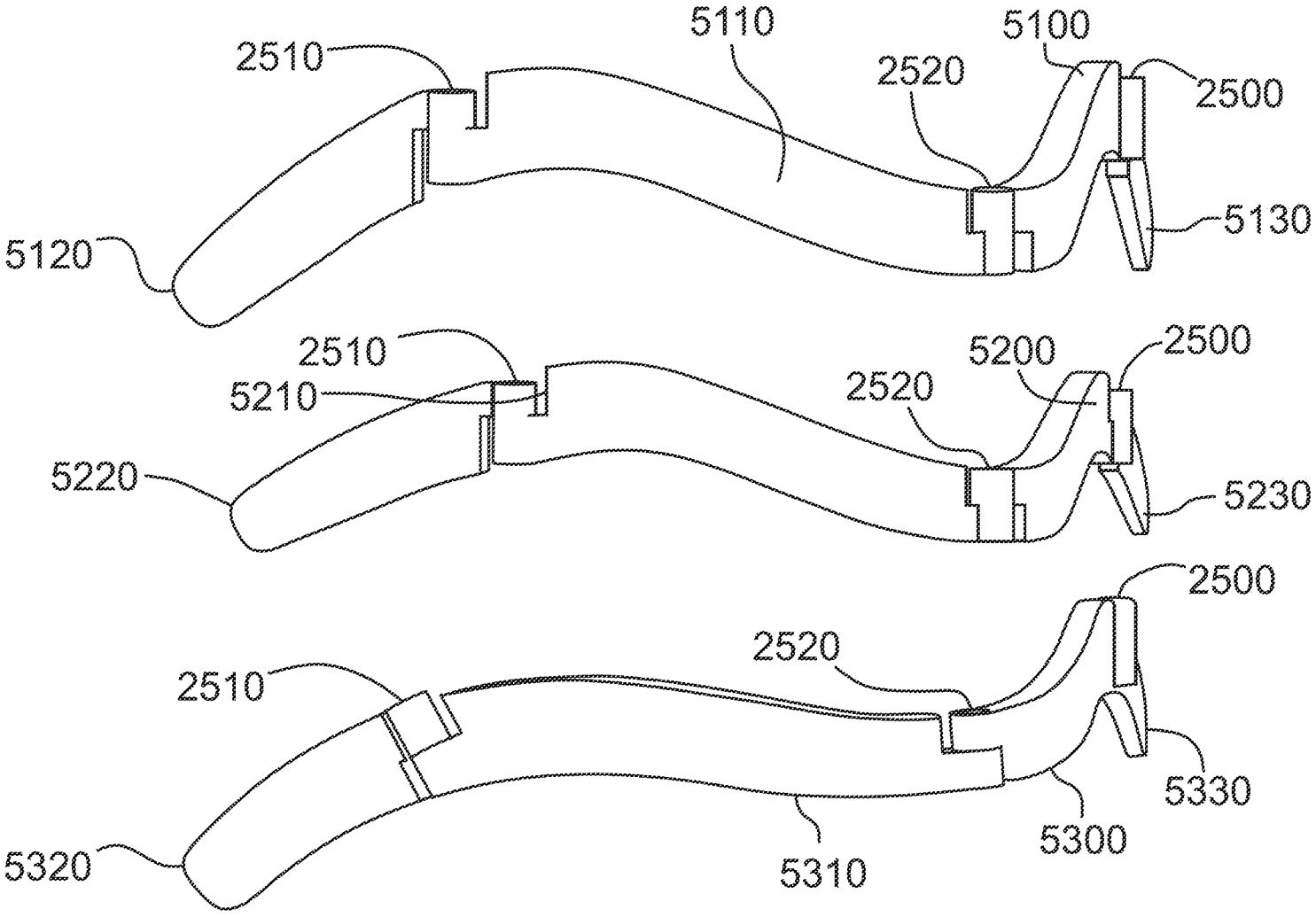
FIG. 5 shows front, off-center views of different adjustable gullet plate embodiments with apex and terminal portions of different dimensions, curvature, and design.

According to an embodiment as shown in FIG. 5, adjustable gullet plates comprised of apex portions 5100 and 5110, 5200 and 5210, or 5300 and 5310 and terminal portions 5120 and 5130, 5220 and 5230, or 5320 and 5330 are of different dimensions and designs and are secured using screw-based fasteners 2500, 2510, 2520 to create configurations suitable to different horse body shapes or riding purposes. Apex and terminal portions may be manufactured to replicate the natural shape of a horse's body and used interchangeably with other apex and terminal portions to further optimize fit.

Figure 6:
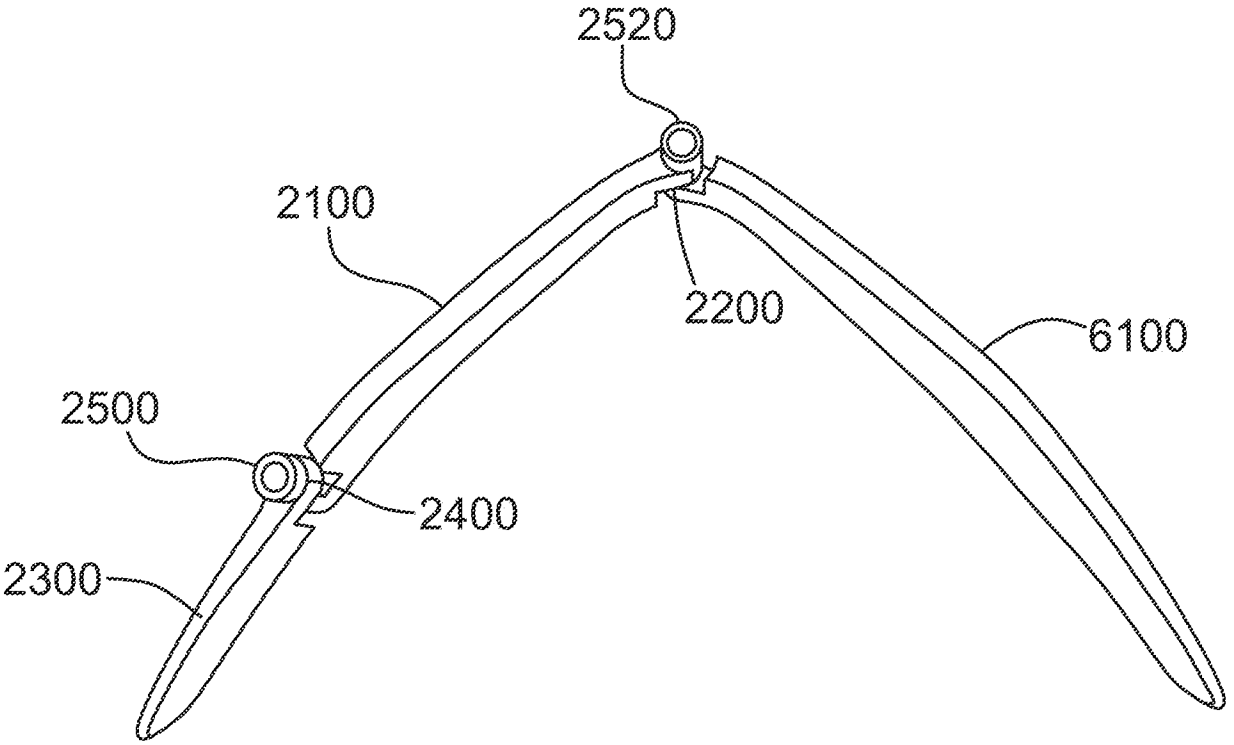
FIG. 6 shows an adjustable gullet plate with only one terminal portion and only one adjustable terminal joint, according to an embodiment.

According to an embodiment as shown in FIG. 6, an adjustable gullet plate is comprised of, at minimum, two apex portions 2100 and 6100, one terminal portion 2300, one adjustable apex joint 2200, and one adjustable terminal joint 2400 secured using two screw-based fasteners 2500 and 2520.

According to an embodiment, the gullet plate is comprised of two apex portions and more than one terminal portion. According to a further embodiment, terminal portions may be connected successively to increase the number of points of adjustment on an adjustable gullet plate. This consequently increases the number of configurations available to optimize fit.

According to an embodiment, the adjustable gullet plate can be adjusted while installed in a saddle. Screw-based fasteners can be accessed through small leather covered apertures on a saddle and loosened to disengage the interlocking elements securing any combination of at least one apex portion or at least one terminal portion. Once loosened, the portions of the gullet plate can be moved radially to adjust the configuration of a gullet plate and match its configuration to a horse's body. Upon identifying a desired configuration, the screw-based fasteners can be tightened to once more engage the interlocking elements on any combination of gullet plate portions to prevent unintended radial movement. According to a further embodiment, the saddle apertures for accessing the screw-based fasteners covered by small leather flaps to protect the joints from the elements.

Figure 7:
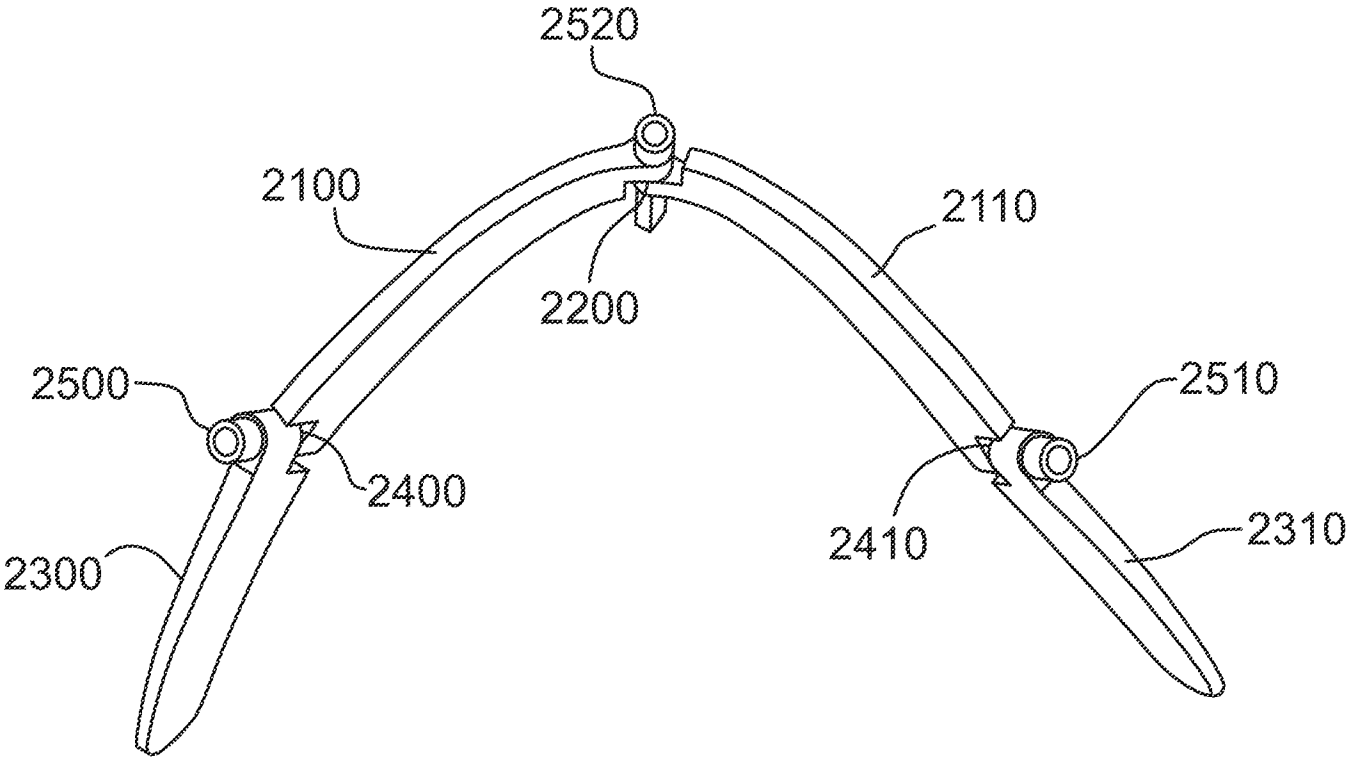
FIG. 7 shows an adjustable gullet plate in an asymmetric configuration, according to an embodiment.

According to an embodiment as shown in FIG. 7, the adjustable gullet plate shown in FIGS. 2(*a*) and 2(*b*) may be configured asymmetrically by adjusting any combination of interior angles at an at least one adjustable terminal joint 2400 or 2410 to change the orientation of an adjustable terminal portion 2300 or 2310 or an interior width of the gullet plate. Since many horses have inherent asymmetry to their musculature and may exhibit a preference for one bilateral side over the other, an asymmetrically configured saddle can help accommodate and correct otherwise harmful asymmetry in a horse's body shape. This reduces the risk of injury, improves a rider's performance, and can help ensure the overall health and longevity of the saddled horse.

According to an embodiment with interlocking elements equally spaced at or at about known increments, the gullet plate can be adjusted in a calculated and trackable manner that maximizes accuracy and precision. If a horse's muscle mass is known to fluctuate throughout a riding season, a user of the adjustable gullet plate may document by what radial degree adjustments are made throughout a season to help expedite subsequent fitting adjustments. For example, if a horse's muscle mass is known to increase over the course of a riding season to peak at a 5° increase for the apex joint and 10° increase for each of two adjustable terminal joints, a rider can reference this historical adjustment data to anticipate that, in subsequent seasons, the horse will likely peak again at a 5° increase for the apex joint and 10° increase for each of two adjustable terminal joints. Asymmetric or symmetric gullet plate adjustments throughout a riding season can then be scheduled to reflect the horse's historical cycle of muscle gain and loss and any changes in posture.

Lastly, being able to assign quantitative data to changes in posture or horse muscle growth during a riding season provides a loose indicator of some aspects of a horse's health. Meaningful inferences can then be drawn from these data. For example, if a horse has historically required a 5° increase for the apex joint and 10° increase for each of two adjustable terminal joints due to a gain in muscle mass over the course of a riding season but fails to meet these benchmarks in a subsequent season, it may indicate a lack of appropriate exercise and training or other health problems.

Various embodiments of the invention have been described in detail. Since changes in and or additions to the above-described best mode may be made without departing from the nature, spirit or scope of the invention, the invention is not to be limited to those details but only by the appended claims. Section headings herein are provided as organizational cues. These headings shall not limit or characterize the invention set out in the appended claims.

What is claimed is:

1. An adjustable gullet plate, comprising:
two apex portions;
an adjustable apex joint;
at least one terminal portion;
at least one adjustable terminal joint;
wherein the two apex portions are connected to the adjustable apex joint;
and wherein at least one of the apex portions is connected to the at least one terminal portion at the at least one adjustable terminal joint;
and wherein each of the apex portions and the at least one terminal portion contain interlocking elements that interlock together;
and wherein the adjustable apex joint and the at least one adjustable terminal joint are secured using at least one fastener.

2. The adjustable gullet plate of claim 1, wherein the interlocking elements are housed within either end of each of the two apex portions and within at least one end of the at least one terminal portion.

3. The adjustable gullet plate of claim 1, wherein the at least one terminal portion is two terminal portions and the at least one adjustable terminal joint is two adjustable terminal joints wherein each of the two terminal portions is connected to one of the two adjustable terminal joints.

4. The adjustable gullet plate of claim 1, wherein the two apex portions and the at least one terminal portion are interchangeable with different apex portions or terminal portions.

5. The adjustable gullet plate of claim 1, wherein the interlocking elements are spaced at equal radial increments.

6. The adjustable gullet plate of claim 5, wherein the interlocking elements are spaced at about 5° radial increments.

7. The adjustable gullet plate of claim 1, wherein dimensions and designs of the two apex portions and the at least one terminal portion are configured for use in an English saddle.

8. The adjustable gullet plate of claim 1, wherein an interior tree angle between any combination of the apex portions or the at least one terminal portion can be increased or decreased using the adjustable apex joint or the at least one adjustable terminal joint and an interior tree width can be increased or decreased using the adjustable apex joint.

9. A saddle, comprising,
a saddle tree;
at least one saddle tree covering;
an adjustable gullet plate, further comprising of
two apex portions,
an adjustable apex joint,
at least one terminal portion, at least one adjustable terminal joint, wherein the two apex portions are connected to the adjustable apex joint, and wherein at least one of the apex portions is connected to the at least one terminal portion at the at least one adjustable terminal joint, and wherein each of the apex portions and the at least one terminal portion contain interlocking elements that interlock together, and wherein the adjustable apex joint and the at least one adjustable terminal joint are secured using at least one fastener.

10. The saddle of claim 9, wherein the adjustable gullet plate is secured to the saddle tree using at least one installation fastener.

11. The saddle of claim 9, wherein the interlocking elements are housed within either end of each of the two apex portions and within at least one end of the at least one terminal portion.

12. The saddle of claim 9, wherein the at least one terminal portion is two terminal portions and the at least one adjustable terminal joint is two adjustable terminal joints wherein each of the two terminal portions is connected to one of the two adjustable terminal joints.

13. The saddle of claim 9, wherein the two apex portions and the at least one terminal portion are interchangeable with different apex portions or terminal portions.

14. The saddle of claim 9, wherein the interlocking elements are spaced at equal radial increments.

15. The saddle of claim 14, wherein the interlocking elements are spaced at about 5° radial increments.

16. The saddle of claim 9, wherein dimensions and designs of the two apex portions, the at least one terminal portion, the saddle tree, and the saddle tree coverings are configured for use in an English saddle.

17. The saddle of claim 9, wherein an interior tree angle between any combination of the apex portions or the at least one terminal portion can be increased or decreased using the adjustable apex joint or the at least one terminal joint and an interior tree width can be increased or decreased using the adjustable apex joint.

18. A method of adjusting an adjustable gullet plate while the adjustable gullet plate is installed in a saddle system, comprising, accessing at least one fastener securing at least one adjustable apex joint and at least one adjustable terminal joint of the adjustable gullet plate;

loosening the at least one fastener to disengage interlocking elements on any combination of at least one apex portion and at least one terminal portion to permit radial movement of the at least one apex portion and the at least one terminal portion;

adjusting the radial displacement of any combination of the at least one apex portion and the at least one terminal portion to adjust at least one interior tree angle and at least one interior tree width to fit a horse's body shape; and tightening the fastener to engage interlocking elements on any combination of the at least one apex portion and the at least one terminal portion to prevent radial movement of the at least one apex portion and the at least one terminal portion.

19. The method of claim 18, wherein the radial displacement of any combination of the at least one apex portion and the at least one terminal portion is adjusted based on at least one equally spaced radial increment of the interlocking elements.

20. The method of claim 18, wherein the adjustment of at least one interior tree angle and at least one interior tree width to fit a horse's body shape creates an asymmetric configuration.

* * * * *